US006425738B1

(12) United States Patent
Shaw

(10) Patent No.: US 6,425,738 B1
(45) Date of Patent: Jul. 30, 2002

(54) ACCORDION NOZZLE

(75) Inventor: James S. Shaw, Hampton Falls, NH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/567,242

(22) Filed: May 11, 2000

(51) Int. Cl.[7] ..... F04D 29/54
(52) U.S. Cl. ..... 415/208.1; 415/209.2
(58) Field of Search ..... 415/208.1, 209.2, 415/209.3, 209.4, 210.1

(56) References Cited

U.S. PATENT DOCUMENTS 3,300,180 A * 1/1967 Tuttle et al. ..... 415/210.1
3,302,926 A * 2/1967 Bobo ..... 415/210.1
3,970,318 A * 7/1976 Tuley ..... 415/209.2
5,174,715 A * 12/1992 Martin ..... 415/20.1
5,197,856 A * 3/1993 Koertge et al. ..... 415/209.2
5,474,419 A * 12/1995 Reluzco et al. ..... 415/210.1
5,797,725 A * 8/1998 Rhodes ..... 415/209.2
6,183,192 B1 * 2/2001 Tressler et al. ..... 415/209.2

* cited by examiner

*Primary Examiner*—John Kwon
(74) *Attorney, Agent, or Firm*—Andrew C. Hess; V. Ramaswamy

(57) ABSTRACT

A gas turbine engine nozzle includes outer and inner bands. Each of the bands includes segments circumferentially adjoining at corresponding splits. The splits of the inner band are circumferentially spaced from the splits of the outer band. A plurality of vanes are fixedly joined to the outer and inner segments which collectively define an accordion load-path therethrough.

24 Claims, 4 Drawing Sheets

ACCORDION NOZZLE

BACKGROUND OF THE INVENTION

The present invention relates generally to gas turbine engines, and, more specifically, to turbine and compressor stator nozzles therein.

A typical gas turbine engine includes a multistage axial compressor through which air is compressed in turn and then mixed with fuel in a combustor and ignited for generating hot combustion gases. The combustion gases flow downstream through corresponding turbines which expand the gases for extracting energy therefrom for powering the compressor, and typically also powering a fan in a turbofan aircraft engine application.

Both the compressor and the turbine include corresponding rows of rotor blades or airfoils extending radially outwardly from supporting rotor disks. Each rotor stage includes a corresponding stator stage defined by an annular nozzle of stator vanes specifically configured for channeling the air for pressurization in the compressor or for channeling the combustion gases for expansion in the turbine.

Although compressors and turbines are functionally different, the corresponding stator nozzles thereof similarly include a row of stator vanes typically mounted from annular outer and inner bands, which in turn are suitably supported to corresponding frames or casings of the engine. Some compressor stators, however, may include solely an outer supporting band, with no inner band being used.

During operation, both the compressor nozzles and turbine nozzles are subject to heating and differential operating temperatures between the outer and inner bands thereof. Air increases in temperature as it is compressed, with the combustion gases having substantially higher temperatures which correspondingly heat the turbine nozzles to even greater temperatures.

Since the stator vanes and supporting bands expand when heated, they are also subject to corresponding thermal growth in diameter, as well as differential radial growth between the outer and inner bands depending upon the particular mode of operation of the engine.

In order to prevent unacceptable restraint in growth of the heated vanes during operation, the supporting outer and inner bands thereof are commonly formed in discrete, arcuate segments for circumferentially interrupting the annular hoop path of the respective nozzles. In this way, the nozzle segments are free to expand and contract relative to adjoining segments for reducing thermally generated reaction stresses during operation.

However, the segmented nozzle bands are subject to leakage through the corresponding splits or gaps therebetween which are commonly sealed for minimizing leakage thereof for maintaining high efficiency of both the compressor and turbine. Typical band seals are in the form of discrete leaf seal elements which are axially disposed in complementary seal grooves formed in the circumferential end faces of the band splitlines.

The resulting construction of the compressor stator nozzles and turbine nozzles include a large number of individual components, including the band seals therefor, and correspondingly increases the complexity of manufacture and cost. However, since the vanes are typically arranged in groups of two or more in each band segment, the segments are readily repairable by removing any one or more of the damaged vane segments and substituting replacement segments.

Accordingly, it is desired to provide an improved nozzle for gas turbine engine compressors and turbines having reduced cost of manufacture and assembly in a simplified construction.

BRIEF SUMMARY OF THE INVENTION

A gas turbine engine nozzle includes outer and inner bands. Each of the bands includes segments circumferentially adjoining at corresponding splits. The splits of the inner band are circumferentially spaced from the splits of the outer band. A plurality of vanes are fixedly joined to the outer and inner segments which collectively define an accordion loadpath therethrough.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
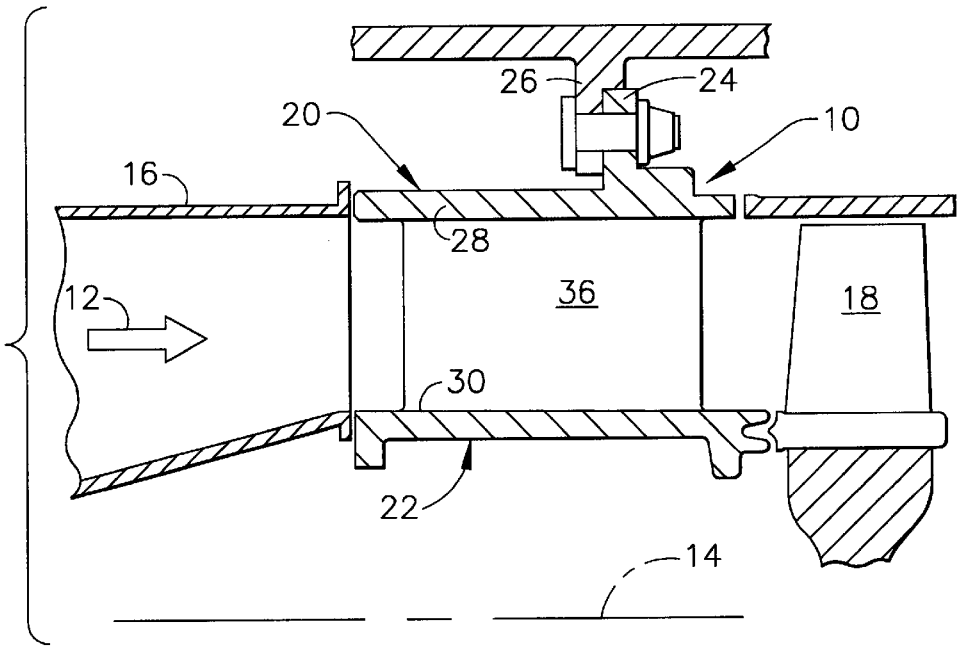
FIG. 1 is an axial sectional view through a portion of a gas turbine engine turbine nozzle in accordance with an exemplary embodiment of the present invention.

Illustrated schematically in FIG. 1 is an exemplary nozzle 10 of a gas turbine engine, shown in part, in accordance with an exemplary embodiment of the present invention. The nozzle 10 is in the exemplary form of a first stage turbine nozzle for channeling hot combustion gases 12 therethrough during operation.

The nozzle 10 is axisymmetrical in annular, ring form about an axial centerline axis 14 of the engine. Disposed directly upstream therefrom is an annular combustor 16, shown in aft part, in which the combustion gases are generated by mixing fuel with air pressurized in an upstream multistage axial compressor (not shown) in a conventional manner. The combustion gases flow downstream through the nozzle which directs the gases through a row of first stage, high pressure turbine rotor blades 18 extending radially outwardly from a supporting disk which is suitably joined to the compressor rotor for powering the compressor during operation.

Figure 2:
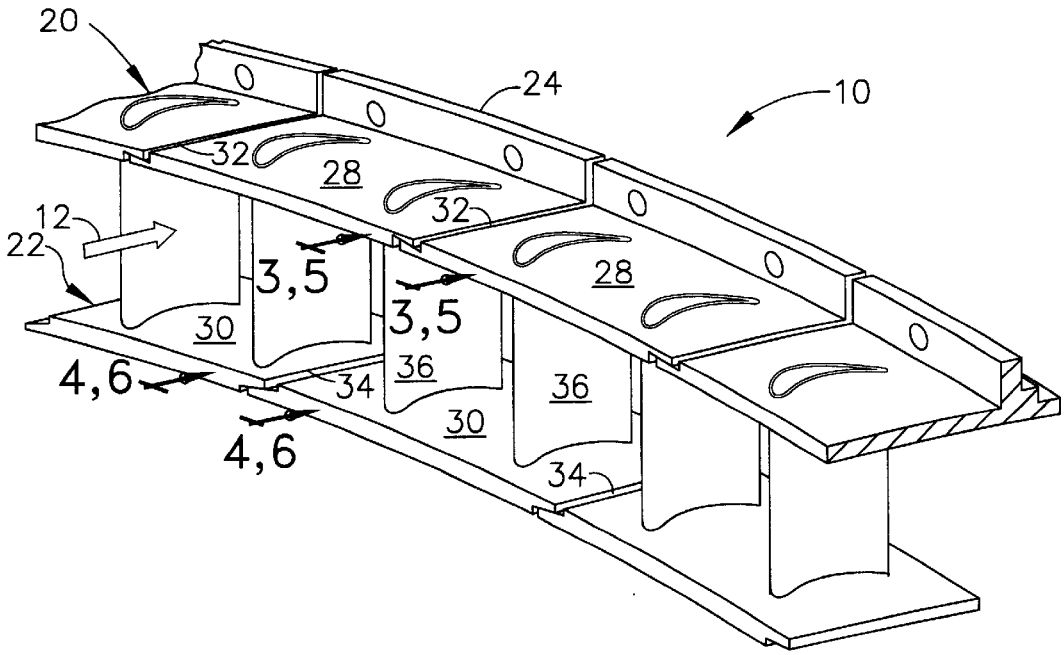
FIG. 2 is an isometric view of a portion of the turbine nozzle illustrated in FIG. 1.

In the exemplary embodiment illustrated in FIGS. 1 and 2, the turbine nozzle 10 includes an arcuate outer band 20 and an arcuate inner band 22 spaced radially inwardly therefrom. The nozzle 10 may be supported in the engine from either its outer or inner band, and in the exemplary embodiment illustrated in FIGS. 1 and 2, includes a radially outer flange 24 which is seated in a supporting flange 26 of an annular supporting casing and retained thereto by a plurality of axial fasteners in a conventional manner.

In accordance with the present invention, the outer band 20 illustrated in FIG. 2 includes a plurality of unitary outer segments 28 disposed circumferentially end-to-end around the perimeter of the nozzle. Similarly, the inner band 22 includes a plurality of unitary inner segments 30 disposed circumferentially end-to-end around the inner diameter of the nozzle.

The outer segments 28 are circumferentially abutting or adjoining at corresponding outer splits 32 which extend axially through the outer band for completely severing or cutting the outer segments from each other in the circumferential hoop direction. Similarly, the inner segments 30 are circumferentially abutting or adjoining at corresponding inner splits 34 which extend axially completely through the inner band for completely severing or cutting the inner segments from each other.

In order to maintain structural continuity around the circumference of the nozzle, the inner splits 34 are spaced or indexed circumferentially from the outer splits 32. And, a plurality of stator airfoils or vanes 36 are circumferentially spaced apart from each other and extend radially with opposite ends being fixedly joined to corresponding ones of the outer and inner segments 28,30 in any conventional manner.

For the turbine nozzle example illustrated in FIG. 2, the vanes 36 are hollow and supplied with bleed air from the compressor for cooling the vanes in accordance with conventional practice, and are not further described herein.

As illustrated in FIG. 2, the outer and inner splits 32,34 are respectively disposed circumferentially between different pairs of adjacent vanes 36 for maintaining circumferential continuity around the nozzle. Preferably, the outer and inner splits 32,34 alternate circumferentially between the outer and inner bands 20,22, and the outer and inner segments 28,30 are circumferentially continuous between adjacent vanes radially oppositely from respective ones of the inner and outer splits 34,32.

In the exemplary embodiment illustrated in FIG. 2, there are two vanes per segment in each of the outer and inner segments 28,30, with the outer and inner segments being interconnected by common ones of the vanes circumferentially between adjacent outer and inner splits 32,34.

In this way, the nozzle 10 may be configured as a full 360 degree ring, with the outer and inner bands 20,22 being annular, and segmented circumferentially solely by the respective outer and inner splits 32,34 therein. A circumferentially continuous loadpath is collectively provided by the outer and inner bands interconnected by the vanes, yet, at the same time, the outer and inner bands are circumferentially segmented for permitting relatively free expansion and contraction thereof during operation without creating undesirable restraining loads with correspondingly high thermal stress which would otherwise occur in fully continuous outer and inner bands.

As shown in FIG. 2, the two common vanes of each outer segment 28 are fixedly joined together by the continuous outer segment therebetween. Similarly, an interconnected pair of vanes 36 are fixedly joined together by each of the inner segments 30. A common vane 36 joins each of the outer segments to a corresponding inner segment for maintaining circumferential continuity from segment-to-segment around the perimeter of the nozzle as desired.

This alternating use of the axial splits 32,34 for severing the corresponding outer and inner bands 20,22 creates, in effect, an accordion nozzle having a loadpath alternating circumferentially and radially between the outer and inner bands joined together by the stator vanes. The accordion nozzle thusly has circumferential continuity, yet with circumferential flexibility for permitting limited differential expansion and contraction of the nozzle during operation as it is subject to different operating temperatures from the combustion gases.

The accordion nozzle is thusly free to expand and contract with the several segments of the outer and inner bands being joined together for maintaining a unitary but segmented nozzle assembly.

Figure 3:
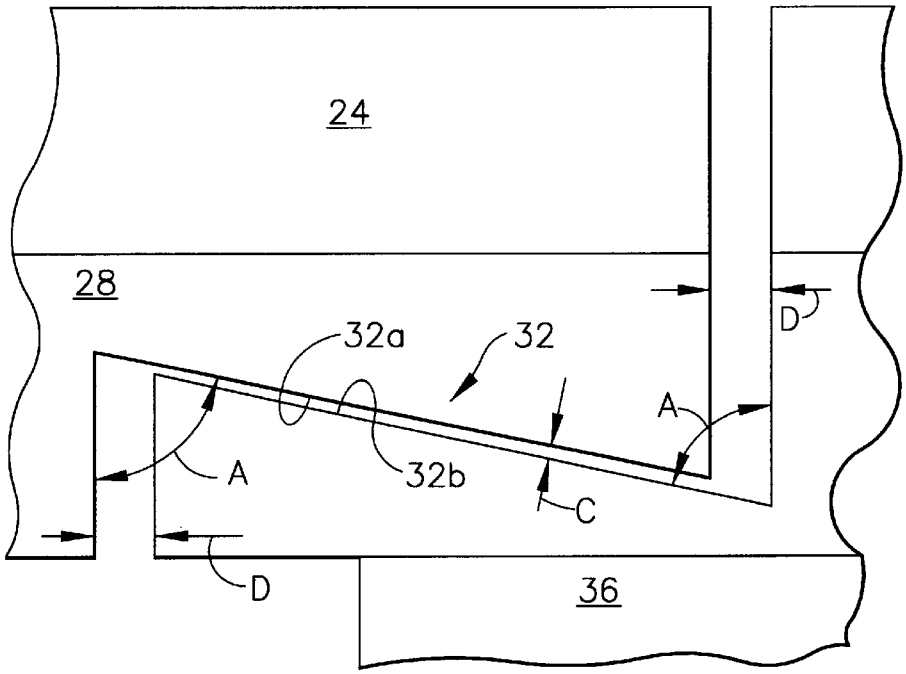
FIG. 3 is an enlarged radial face view of an exemplary outer split in the outer band illustrated in FIG. 2 and taken along line 3—3 in a nominal, cold position.
Figure 4:
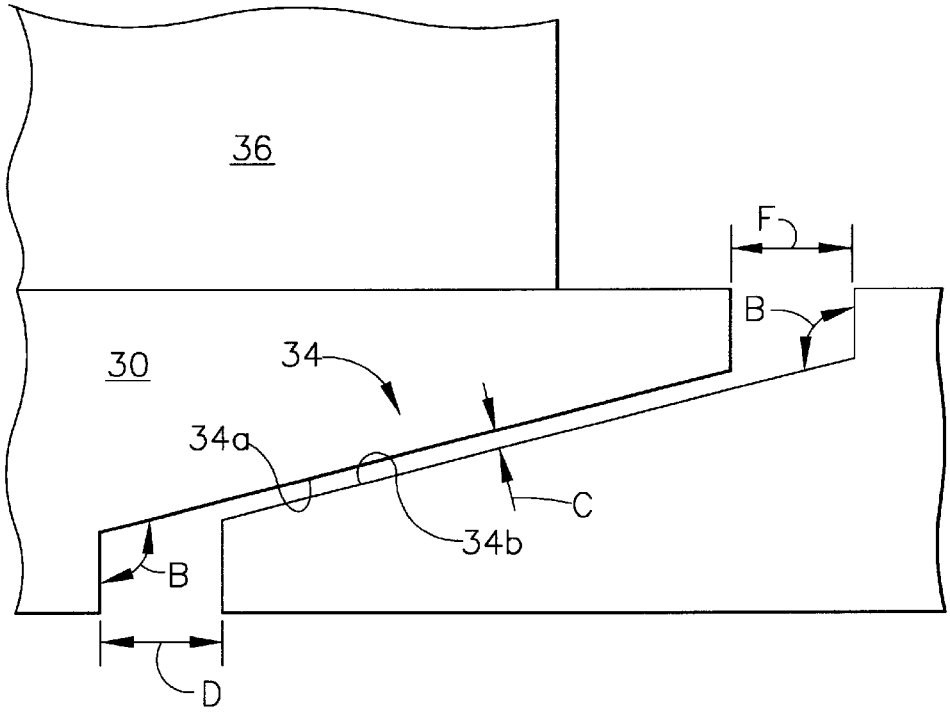
FIG. 4 is a radial face view of an exemplary inner split of the inner band illustrated in FIG. 2 and taken along line 4—4 of FIG. 2 in a nominal, cold position.

FIGS. 3 and 4 illustrate end views of the outer and inner splits 32,34 in more particularity. In these FIGURES, the outer and inner bands 28,30 have a nominal room temperature, or relatively cold, position for illustrating the preferred form of the splits. The outer and inner segments 28,30 radially overlap at the respective outer and inner splits 32,34 thereof for providing an inherent seal structure therein, with the outer and inner splits being preferably empty without the need for separate seal strips as otherwise used in conventional turbine nozzles.

As shown in FIG. 3, the outer split 32 preferably includes a pair of outboard and inboard split faces 32*a,b* which are parallel to each other and inclined circumferentially and radially relative to the outer segments 28. Similarly, the inner splits 34 illustrated in FIG. 4 include respective outboard and inboard split faces 34*a,b* also inclined circumferentially and radially relative to the inner segments 30. The respective faces of the inner and outer splits are preferably flat and extend in the axial direction across the full width of the segments, and are positioned generally equidistantly between adjacent ones of the vanes.

Although the split faces could extend circumferentially or tangentially without inclination, the inclination is preferably provided to ensure that the split faces engage each other during thermal expansion of the nozzle for providing a relatively tight friction seal therebetween. However, the orientation of the inclination must be selected depending upon the relative expansion of the outer and inner bands, which is controlled by whether the nozzle is supported at its outer band as shown in FIG. 1, or at its inner band in an alternate embodiment (not shown).

With the outer band support illustrated in FIG. 1, as the vanes 36 are heated by the combustion gases 12 during operation the casing and the support flange 26 along with the outer band 20 expand and grow in diameter, with the vanes 36 themselves also expanding in the radial direction, which in turn interferes with the radial expansion of the inner band.

Accordingly, the outer split 32 illustrated in FIGS. 3 and 4 preferably has an acute inclination angle A between the split faces and the segment ends or radial axis. And, the inner splits 34 illustrated in FIGS. 4 and 6 have an obtuse inclination angle B between the faces thereof and the ends of the segments or radial axis.

In this way, the initial cold radial gap C between the corresponding faces of the outer and inner splits illustrated in FIGS. 3 and 4 is preselected to close upon achieving a desired running condition, under hot operation such as cruise operation in an aircraft engine application for example.

Figure 5:
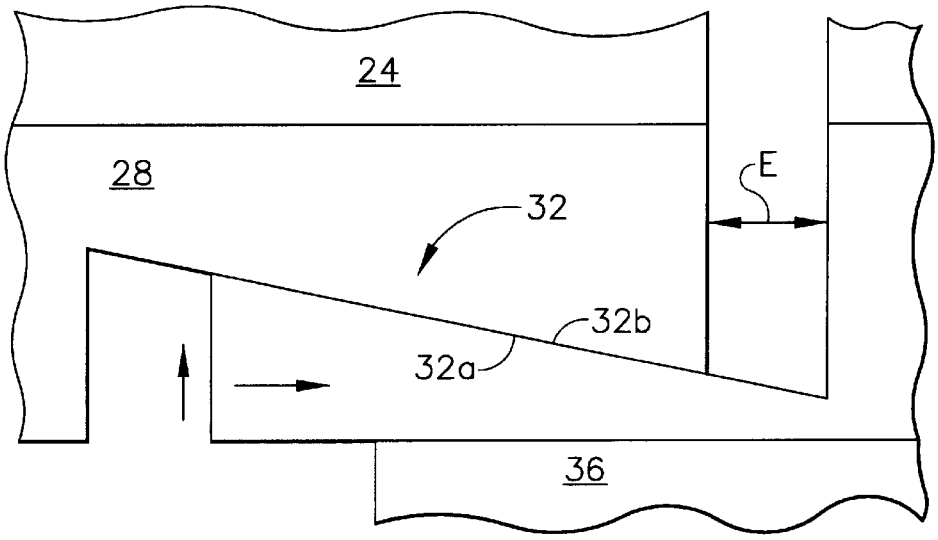
FIG. 5 is a copy of FIG. 3 in a heated, expanded position.

As shown in FIG. 5, as the outer segments 38 are heated during operation they expand and the perimeter of the nozzle increases in length and creates relative circumferential movement between the split faces as shown. The outer segments separate slightly circumferentially from each other to close the radial gap C therebetween for effecting a friction seal thereat during the hot, running condition.

Figure 6:
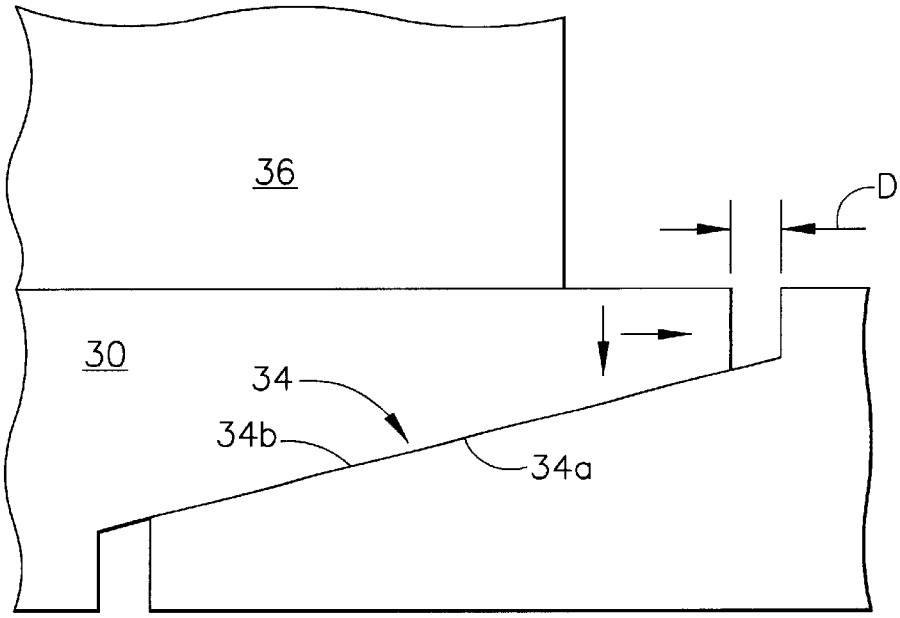
FIG. 6 is a copy of FIG. 4 in a heated, expanded position.

As shown in FIGS. 6, as the inner segments 30 are restrained by the expanding vanes 36 during operation, the circumference of the inner band decreases slightly for effecting relative circumferential movement between the inner segments which also closes the radial gap C therebetween.

Accordingly, depending on whether a diameter or circumference of the inner and outer bands increases or decreases during operation corresponding ones of the inclined splits 32, 34 may be used in those bands for ensuring closing of the radial gap when heated.

Referring again to FIGS. 3 and 4, the outer and inner splits 32, 34 preferably also have respective circumferential gaps D,F between the circumferentially opposite ends of each segment bordering the respective split faces.

Accordingly, as the outer band increases in diameter upon heating as illustrated between FIGS. 3 and 5, the radial gaps C close and the end gaps D increase to a larger gap E. Correspondingly, as the diameter of the inner band decreases during operation as illustrated between FIGS. 4 and 6, the end gaps F decrease to a smaller gap D.

The initial inclination angles A,B of the split faces are selected in conjunction with the desired change in end gaps at the splitlines to close the radial gaps C at a preferred running condition, without closing the end gaps F or excessively increasing the size of the gaps D. In a preferred embodiment, the acute angle A is about 72 ½ degrees and the obtuse angle B is about 107 ½ degrees, which is a common 17 ½ degree taper angle of the respective faces with opposite directions.

Correspondingly, the initial cold end gaps D for the outer splits 32 is about 1.0 mm which increases to about a double size of about 2.0 mm for the hot running gap E illustrated in FIG. 5.

Correspondingly, the initial cold end gap F is about 2.0 mm and decreases in half to the hot end gap D of about 1.0 mm, which matches the initial cold end gap of the outer segments illustrated in FIG. 3.

In this way, the respective split faces of the outer and inner splits 32,34 close upon reaching a predetermined running condition, with the corresponding end gaps either decreasing or increasing within a predetermined small range of about 1.0–2.0 mm.

The initial radial gap C of the splits illustrated in FIGS. 3 and 4 may be relatively small, and is preferably about 0.3 mm. Such a small gap may be readily and accurately manufactured in accordance with a preferred manufacturing method of the present invention illustrated schematically in FIG. 7.

Figure 7:
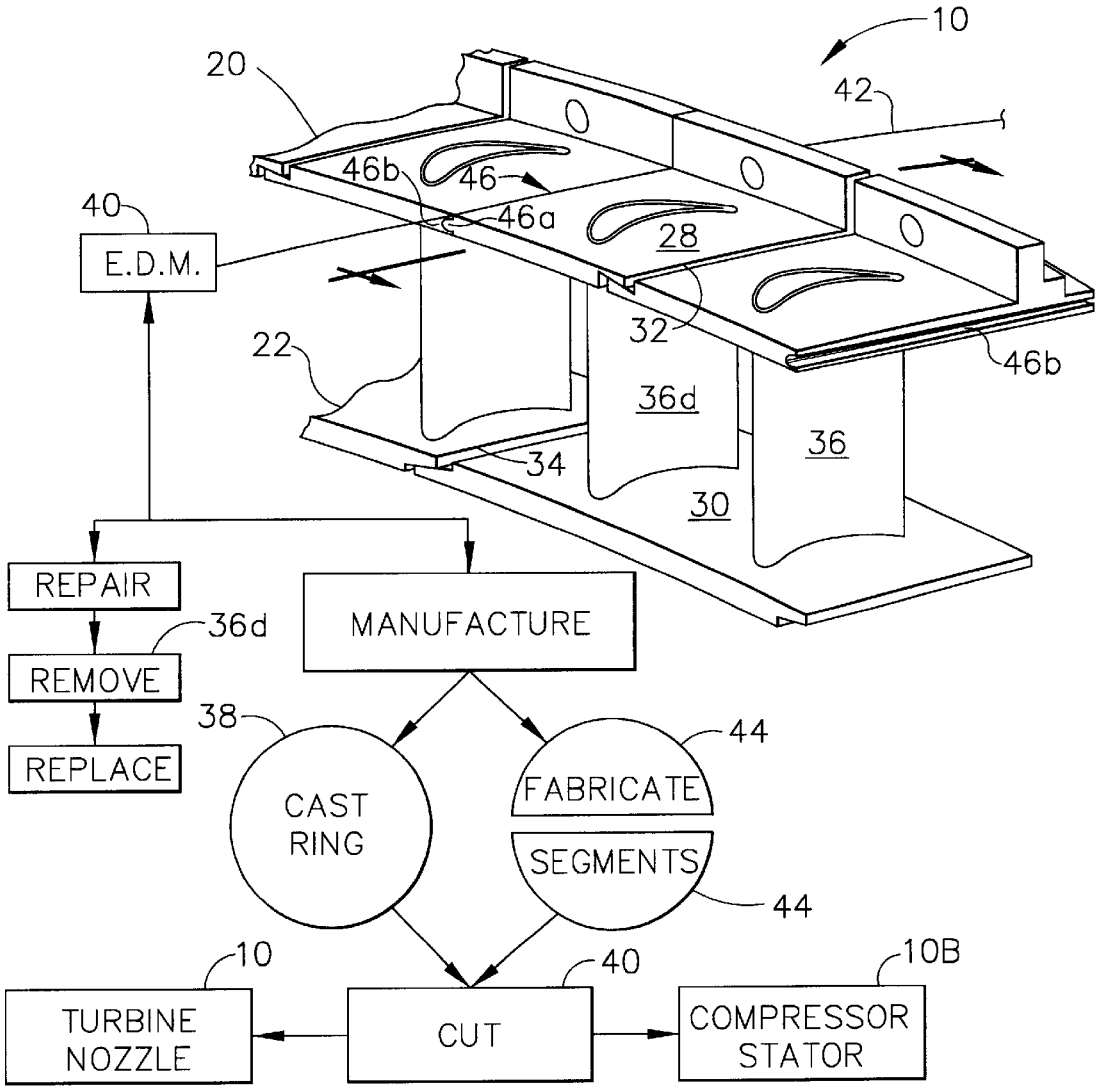
FIG. 7 is a flowchart representation of corresponding methods of making the nozzle illustrated in FIGS. 1–6, making a similarly configured compressor stator nozzle, and repairing such nozzles.

More specifically, the turbine nozzle 10 illustrated schematically in part in FIG. 7 may be made by initially forming the outer and inner bands 20,22 in circumferentially continuous components along with the vanes 36 integrally attached thereto in a common unitary annular member or ring 38. For the turbine nozzle embodiment of the invention, the outer and inner bands 20,22 and vanes 36 are preferably formed by casting in the unitary ring 38.

The unitary outer and inner bands may then be cut at several circumferential locations to correspondingly form the outer and inner splits 32, 34 and the circumferentially adjoining outer and inner segments 28,30 thereat.

The band cutting is preferably effected using a conventional electrical discharge machine 40 in which an electrical discharge machining (EDM) wire 42 is suitably guided through the respective bands for cutting the individual splits 32,34 to shape using electrical discharge machining.

FIG. 7 also illustrates schematically that the outer and inner bands 20,22 and interconnected vanes 36 may be formed by fabrication in two distinct, semi-circular ring halves 44, with each having a 180 degree circumferential configuration.

In this configuration, the accordion nozzle is in the form of a compressor stator 10B for channeling pressurized air therethrough in a multistage axial compressor. A typical axial compressor includes two half casings in which the several compressor stator stages are independently mounted.

The inner and outer bands in a compressor are typically fabricated from sheet metal, with the hollow compressor vanes being fixedly joined thereto typically by brazing. The corresponding outer and inner bands 20,22 are preferably semi-circular, and in each stator half 44, the corresponding alternating outer and inner splits 32,34 may be similarly formed using EDM machining.

The resulting stator halves 44 may be conventionally mounted in supporting casings in a gas turbine engine compressor. Similarly, the corresponding full-ring turbine nozzle 10 may also be conventionally mounted in a gas turbine engine turbine, such as a high pressure stator nozzle. Both accordion embodiments enjoy the benefits of the interconnected vanes which are free to expand and contract while maintaining structural continuity in the nozzles.

However, since the full nozzle ring or nozzle segments have structurally interconnected vanes, the individual vanes may not be readily removed from the nozzles in the manner of discrete vanes or vane segments as conventionally used in engines.

Accordingly, FIG. 7 also illustrates an exemplary method of repairing the nozzle 10 in any of its various forms in which the vanes 36 are interconnected by the corresponding outer and inner band segments 28,30. The same EDM machine 40 may be used for cutting any one of the outer and inner band segments 28,30 as desired to define a joint 46 therein which is located between a damaged vane, designated 36*d*, and an adjoining vane. The joint 46 is EDM cut through the corresponding segment in the solid region between adjacent vanes wherein the splits are not found.

Two of the joints 46 are required to interrupt the accordion ring connection for permitting removal of the damaged vane 36d, an adjacent vane, and the outer and inner segments 28,30 attached thereto between the two joints 46. The next adjacent outer and inner splits 32,34 cooperate with the joints 46 for providing four sites permitting removal of the damaged vane.

The repair is completed by installing a pair of replacement vanes 36 and attached outer and inner segments having the same configuration and joint geometry as the removed segment, which is installed in the reverse order at the same joints 46.

Although either the outer or inner segment may be cut at two circumferentially spaced apart locations to liberate the damaged vane along with an adjacent vane, the joints 46 may instead be cut in both outer and inner segments to liberate a single damaged vane if desired.

Figure 8:
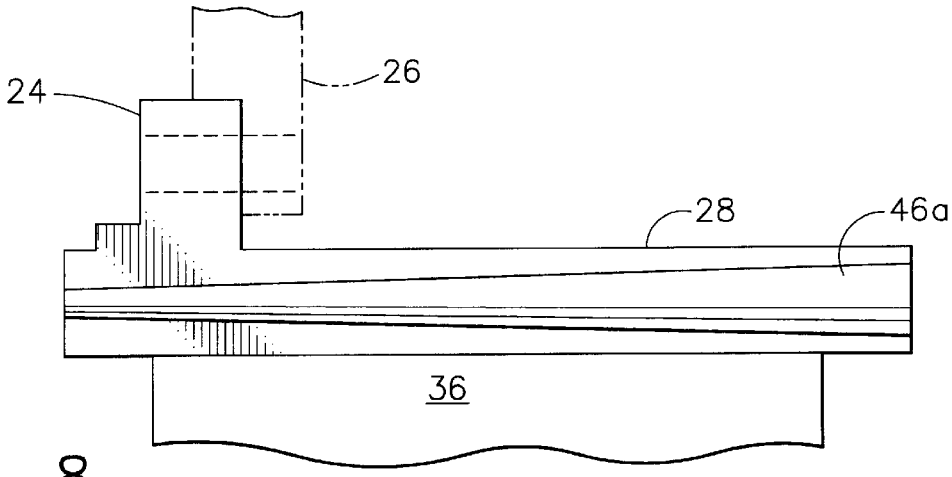
FIG. 8 is an enlarged, axial side view of an exemplary joint cut in the outer band of the nozzle illustrated in FIG. 7 along line 8—8 for repair thereof.

In the preferred embodiment illustrated in FIGS. 7 and 8, the joints 46 are EDM cut axially through two adjoining segments 28 or 30 to define tongue and groove portions therein. In the exemplary embodiment illustrated in FIG. 7, the tongue 46*a* is semicircular, and the complementary groove 46*b* is similarly semicircular with the remainder of the joint having axially and radially extending faces.

In the preferred embodiment illustrated in FIG. 8, the joint 46 is axially tapered for permitting installation of the replacement vane and segments from one side only of the nozzle. In FIG. 8, the upstream or axially forward end of the tongue 46*a* has a larger radius than the downstream or aft end of the tongue. The complementary groove is similarly configured.

In this way, the replacement segment may only be installed in one direction and then is automatically locked in position upon attachment of the outer flange 24 to the mounting flange 26 shown in FIG. 1. Even without installation of the mounting fastener at this location, the replacement segment cannot be liberated from the supporting flange 26 due to its interconnection with adjacent nozzle segments.

The resulting joints 46 not only permit repair of the otherwise circumferentially continuous nozzle, but reestablish mechanical interconnections in the severed segments. The repair may be formed in this manner by severing either the outer segments 28 or the inner segments 30, or both, as desired. For the outer band supported nozzle, only the outer band is preferably severed, and if the nozzle were supported at its inner band, then only the inner band should be severed to provide the joint 46 thereat.

The accordion nozzle described above in various embodiments enjoys simplicity of manufacture, with correspondingly reduced cost of manufacture and assembly. No additional sealing elements are required at the several outer and inner splits, which are relatively narrow and provide effective sealing which improves as the radial gap is reduced or eliminated. When the nozzle is made by casting, a single full-ring casting may be made with correspondingly reduced cost as opposed to casting individual nozzle segments as is commonly done. And, the accordion nozzle is relatively easy to repair and returned to its structural and functional integrity.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A gas turbine engine nozzle comprising:

an arcuate outer band including a plurality of outer segments circumferentially adjoining at corresponding outer splits;

an arcuate inner band spaced radially from said outer band, and including a plurality of inner segments circumferentially adjoining at corresponding inner splits spaced circumferentially from said outer splits; and a plurality of circumferentially spaced apart vanes fixedly interconnecting said outer and inner segments between adjacent outer and inner splits.

2. A nozzle according to claim 1 wherein said outer and inner splits are respectively disposed circumferentially between different pairs of adjacent vanes.

3. A nozzle according to claim 1 wherein:

said outer and inner splits alternate circumferentially between said outer and inner bands; and said outer and inner segments are circumferentially continuous between adjacent vanes radially oppositely from respective ones of said inner and outer splits.

4. A nozzle according to claim 3 wherein said outer and inner segments radially overlap at said outer and inner splits, respectively.

5. A nozzle according to claim 4 wherein said outer and inner splits include respective split faces inclined relative to said outer and inner segments, respectively.

6. A nozzle according to claim 5 wherein said outer splits have an acute inclination of said faces thereof, and said inner splits have an obtuse inclination of said faces thereof.

7. A nozzle according to claim 5 wherein said outer and inner splits have respective end gaps at opposite circumferential ends of said split faces.

8. A nozzle according to claim 5 wherein said outer and inner splits are empty.

9. A nozzle according to claim 4 wherein said outer and inner bands are annular, and segmented circumferentially solely by said respective outer and inner splits therein.

10. A nozzle according to claim 9 in the form of a turbine nozzle for channeling combustion gases therethrough.

11. A nozzle according to claim 4 wherein said outer and inner bands are semi-circular, and segmented circumferentially solely by said respective outer and inner splits therein.

12. A nozzle according to claim 11 in the form of a compressor stator for channeling pressurized air therethrough.

13. A gas turbine engine nozzle comprising:

an arcuate outer band including a plurality of outer segments circumferentially adjoining at corresponding outer splits;

an arcuate inner band spaced radially from said outer band, and including a plurality of inner segments circumferentially adjoining at corresponding inner splits spaced circumferentially from said outer splits;

a plurality of circumferentially spaced apart vanes fixedly joined to said outer and inner segments;

said outer and inner splits alternating circumferentially between said outer and inner bands; and said outer and inner segments being circumferentially continuous between adjacent vanes radially oppositely from respective ones of said inner and outer splits.

14. A nozzle according to claim 13 wherein:

said outer and inner segments radially overlap at said outer and inner splits, respectively; and said outer and inner splits include respective split faces inclined relative to said outer and inner segments, respectively.

15. A nozzle according to claim 14 wherein said outer and inner splits have respective end gaps at opposite circumferential ends of said split faces.

16. A nozzle according to claim 15 wherein said outer splits have an acute inclination of said faces thereof, and said inner splits have an obtuse inclination of said faces thereof.

17. A method of making said nozzle according to claim 1 comprising:

forming said outer and inner bands circumferentially continuous with said vanes attached thereto; and cutting said outer and inner bands to form said corresponding splits therein and said circumferentially adjoining segments thereat.

18. A method according to claim 17 wherein said band cutting is effected by wire electrical discharge machining.

19. A method according to claim 18 wherein said outer and inner bands and vanes are formed by casting in a ring.

20. A method according to claim 18 wherein said outer and inner bands and vanes are formed by fabrication in two distinct ring halves.

21. A method of repairing said nozzle according to claim 1 comprising:

cutting a pair of said outer and inner segments to define joints therein for liberating a damaged vane;

removing said damaged vane and attached outer and inner segments at said joints; and installing a replacement vane and attached outer and inner segments at said joints.

22. A method according to claim 21 wherein said joints are cut axially through said segment pair to define tongue and groove portions on adjoining ones of said segments.

23. A method according to claim 22 wherein said joints are axially tapered for permitting installation of said replacement vane and segments from one side only of said nozzle.

24. An accordion nozzle having a loadpath alternating circumferentially between outer and inner band segments joined together by starter vanes.

* * * * *